US005667274A

United States Patent [19]

Blackman

[11] Patent Number: 5,667,274

[45] Date of Patent: Sep. 16, 1997

[54] ADJUSTABLE CHAIR

[76] Inventor: Sanford Blackman, 2609 E. Maryland Dr., Tempe, Ariz. 85281-5006

[21] Appl. No.: 548,324

[22] Filed: Nov. 1, 1995

[51] Int. Cl.[6] ..... A47C 3/34

[52] U.S. Cl. ..... 297/338; 297/353

[58] Field of Search ..... 297/338, 344.14, 297/353, 423.12, 423.13

[56] References Cited

U.S. PATENT DOCUMENTS

| | | | |
|---|---|---|---|
| 349,129 | 9/1886 | Watson . | |
| 4,614,378 | 9/1986 | Picou | 297/423.13 X |
| 5,330,254 | 7/1994 | Larson | 297/423.13 X |
| 5,383,712 | 1/1995 | Perry | 297/448.2 |
| 5,487,590 | 1/1996 | Haynes | 297/338 X |

FOREIGN PATENT DOCUMENTS

| | | | |
|---|---|---|---|
| 515 802 | 10/1929 | Germany . | |
| 3323171 | 1/1985 | Germany | 297/338 |
| 3401314 | 7/1985 | Germany | 297/338 |
| 689287 | 3/1951 | United Kingdom . | |
| 1427266 | 3/1976 | United Kingdom . | |
| 8800016 | 1/1988 | WIPO | 297/423.12 |

*Primary Examiner*—Peter R. Brown
*Attorney, Agent, or Firm*—LaValle D. Ptak

[57] ABSTRACT

An adjustable chair for supporting a human body including a base having a first body supporting element and a second body supporting element disposed in angular, telescoping, and diverging relation relative to one another and being telescopingly and divergingly adjustable from a first position encompassing a first seating area, a first seating height, and a first back support height, and a second position encompassing a second larger seating area, a second higher seating height, and a second higher back support height.

4 Claims, 3 Drawing Sheets

ADJUSTABLE CHAIR

BACKGROUND OF THE INVENTION

1. Field of the Invention

This invention relates to chairs.

More particularly, this invention relates to adjustable chairs.

In a further and more specific aspect, the instant invention relates to a chair for supporting the human body, and for adjusting to meet unique anthropomorphic characteristics of individuals.

2. Prior Art

Chairs are very well known in the prior art and normally consist of a movable piece of furniture designed for the use of one person and consisting of a seat, legs, a backrest, and sometimes arms. Chairs are provided in a variety of shapes and sizes, and have been the subject of design experts and design enthusiasts throughout much of modern and pre-modern history. For instance, in the 20th century, professional designers have used newly available materials and techniques to create entirely new chair forms. Modern chair designers routinely focus upon elements such as simplicity of design, comfort, ingenious use of materials, the capability of mass manufacture, and public acceptance. Many exemplary chair forms incorporate movable or adjustable elements which allow one to selectively adjust portions of the chair to a desired and comfortable seating configuration.

For instance, one such chair incorporates a rigid frame member having a seat portion and a separate backrest. Both the seat portion and the backrest are adjustably coupled to the frame allowing for alternate generally up and down adjustment of the seat portion and the backrest respectively, thereby allowing the seat height and the height of the backrest to be selectively adjusted. Other chair apparatus incorporate a seat portion rigidly coupled to, or integral with, a backrest, all of which may be selectively adjusted generally up and down along portions of a rigid frame of the chair. Yet still further chair apparatus are of the type having rigid seat portions and rigid backrests which may be selectively folded for compact storage or transport.

The common element inherent with the above mentioned prior art chairs is uni-axial or one-directional selective adjustment. In other words, the seat portions and the backrests of the above mentioned prior art chairs are restrictively adjustable along only one general axis, the axis of which is normally determined by the axis the backrest occupies. Although the ability to adjust the height of both the seat portion and the backrest serves an important function of accommodating some specific anthropomorphic seating needs, the unique array anthropomorphic characteristics encountered from one human being to another are not sufficiently addressed ergonomically by the mere adjustment of height alone.

To meet the specific anthropomorphic characteristics and needs of human beings having a wide range of body types, from the very petite to the very large, the prior art has provided chair or seating apparatus having selectively adjustable lumbar support elements, backrests selectively and pivotally adjustable in relation to seat portions, and seat portions having adjustable seating elements for relieving pressure upon the thighs of the user. These chair or seating apparatus are exemplary for accommodating a wide range of anthropomorphic characteristics. However, these apparatus tend to be considerably expensive and complex to manufacture, and therefore impractical for efficient and inexpensive mass production. Additionally, since these above mentioned apparatus also incorporate many movable and adjustable parts, they tend to break easily or wear down, which can require expensive repair and inconvenience to the user.

Of particular importance in the art of chair and seating apparatus is the daunting task of creating a combination of structural seating elements desirably, selectively, and easily compliant to the specific comfort and perhaps therapeutic needs of the user, thereby allowing personalization in a seating apparatus. The satisfaction of this goal is especially important to appease the wide variety of anthropomorphic characteristics encountered in the children attending the school systems throughout not only the United States, but all countries where children attend educational institutions. As a result of the extensive degree of growth children experience from kindergarten through high school, the need for a chair or seating apparatus for use in the classroom which is able to meet each individual child's specific anthropomorphic needs for proper ergonomically correct seating posture is compelling.

Presently, the chairs that children use during the course of their educational experience are rigid structures which are typically not adjustable. As a result, these chairs can be terribly uncomfortable for children of varying size and shape, especially for children of small stature and large stature. In particular, the chairs specifically used in combination with educational institutions are generally sized for an individual having an average size in relation to a specific age group. For example, kindergarten chairs are specifically sized for the average size of an average kindergarten student. Likewise, grade school chairs are specifically sized for the average size of an average grade school student. However, designing a chair or seating apparatus for an individual of average size in a particular age group places those of non-average size in a position of having to use a chair that is outside their range of comfort and acceptable ergonomic support. As a result of having to use a chair that is either too small, too large, or dimensionally inadequate for supplying correct ergonomic support, individuals tend to slouch, squirm, or otherwise sit in such a way that is contrary to recommended seating posture which can not only cause back pain or other types of pain, but can often lead to poor posture.

It will be readily appreciated that there is a compelling need for a chair or seating apparatus having selectively adjustable elements for meeting a wide and variable range of anthropomorphic needs of individuals having specific and unique physical and ergonomic characteristics.

It would be highly advantageous, therefore, to remedy the foregoing and other deficiencies inherent in the prior art.

Accordingly, it is an object of the present invention to provide a new and improved chair.

Another object of the present invention is to provide a new and improved chair selectively adjustable to accommodate a wide variety of body sizes.

And another object of the present invention is to provide and new and improved chair that is simple and inexpensive to manufacture.

Still another object of the present invention is to provide and new and useful chair that is easy to adjust.

Yet another object of the instant invention is to provide a new and useful chair that provides recommended ergonomic support for individuals having an array of anthropomorphic characteristics.

Yet still another object of the instant invention is to provide a new and useful chair that is comfortable.

And a further object of the invention is to provide a new and useful chair that encourages recommended seating posture as well as a latitude for seated postural changes unavailable in fixed chairs of prior art.

Still a further object of the immediate invention is to provide a new and useful chair that fits a substantially wide range of anthropomorphic variances.

Yet a further object of the invention is to provide a new and useful chair that inhibits poor seating posture.

And still a further object of the invention is to provide a new and useful chair that may be easily repaired if broken.

And a further object of the invention is to provide a new and useful chair that may be easily recycled.

And still a further object of the instant invention is to provide a new and useful chair having an adjustable seating area for selectively accommodating a wide range of specific body types.

SUMMARY OF THE INVENTION

Briefly, to achieve the desired objects of the instant invention in accordance with a preferred embodiment thereof, provided is an adjustable chair for supporting a human body and for adjusting to meet unique anthropomorphic characteristics of individuals, the adjustable chair comprising a base having a first body supporting element and a second body supporting element, both of which are disposed in angular, telescoping, and diverging relation relative one another. The first body supporting element and the second body supporting element are selectively and telescopingly movable and securable between a first position defining a first seating area, a first seating height, and a first back support height, and a second position defining a second larger seating area, a second higher seating height, and a second higher back support height. The first body supporting element and the second body supporting element may be selectively and alternatively adjusted, adjustment of one of said body supporting elements having an anthropomorphic effect in relation to the other of said body supporting elements.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figure 1:
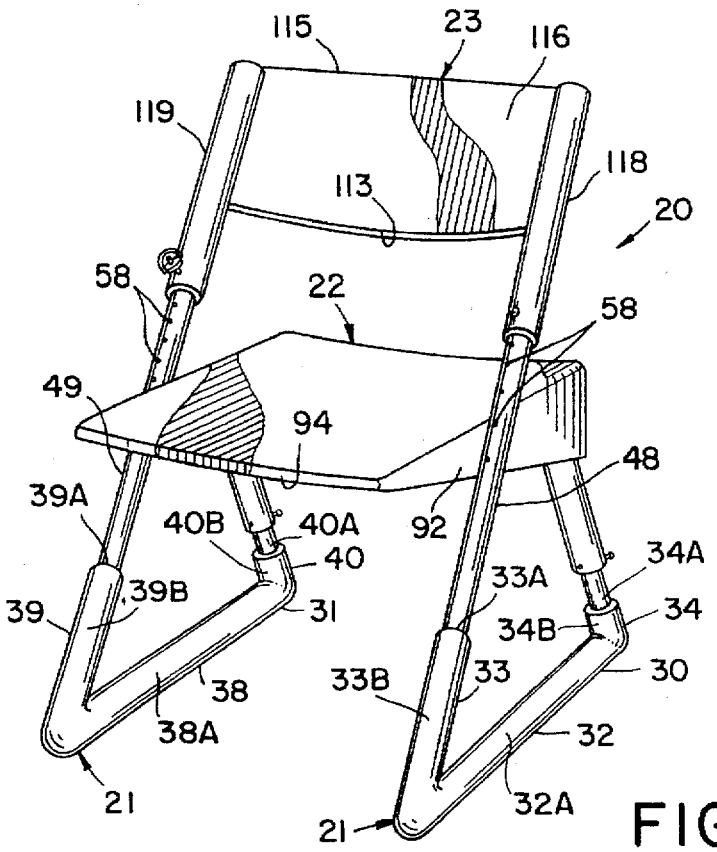
FIG. 1 is a perspective view of an embodiment of the instant invention constructed in accordance with the preferred embodiment.

Turning now to the drawings, in which like reference characters indicate corresponding elements throughout the several views, attention is first directed to FIG. 1 which illustrates a first embodiment of the instant invention comprising an adjustable chair being generally designated by the reference character 20. As can be seen from the above referenced figure, adjustable chair 20 includes a base 21, a first body supporting element 22, and a second body supporting element 23.

Figure 2:
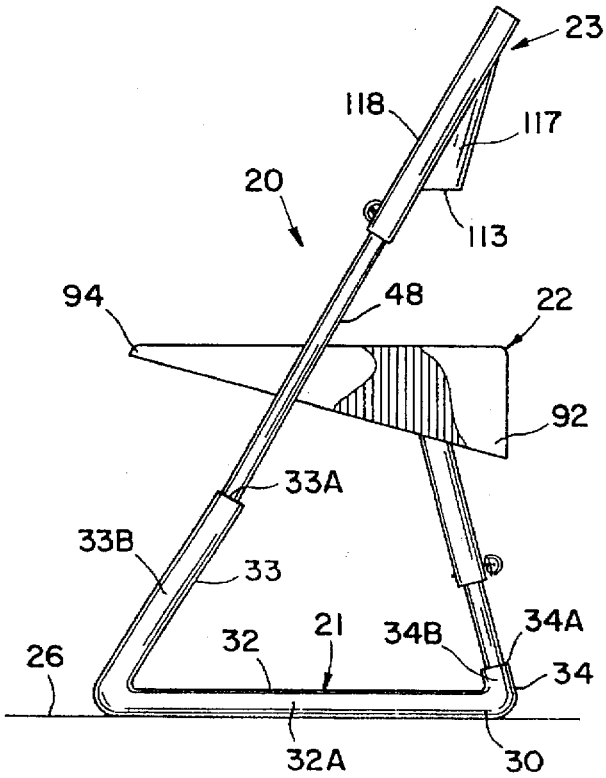
FIG. 2 is a side elevational view of the embodiment illustrated in FIG. 1.
Figure 3:
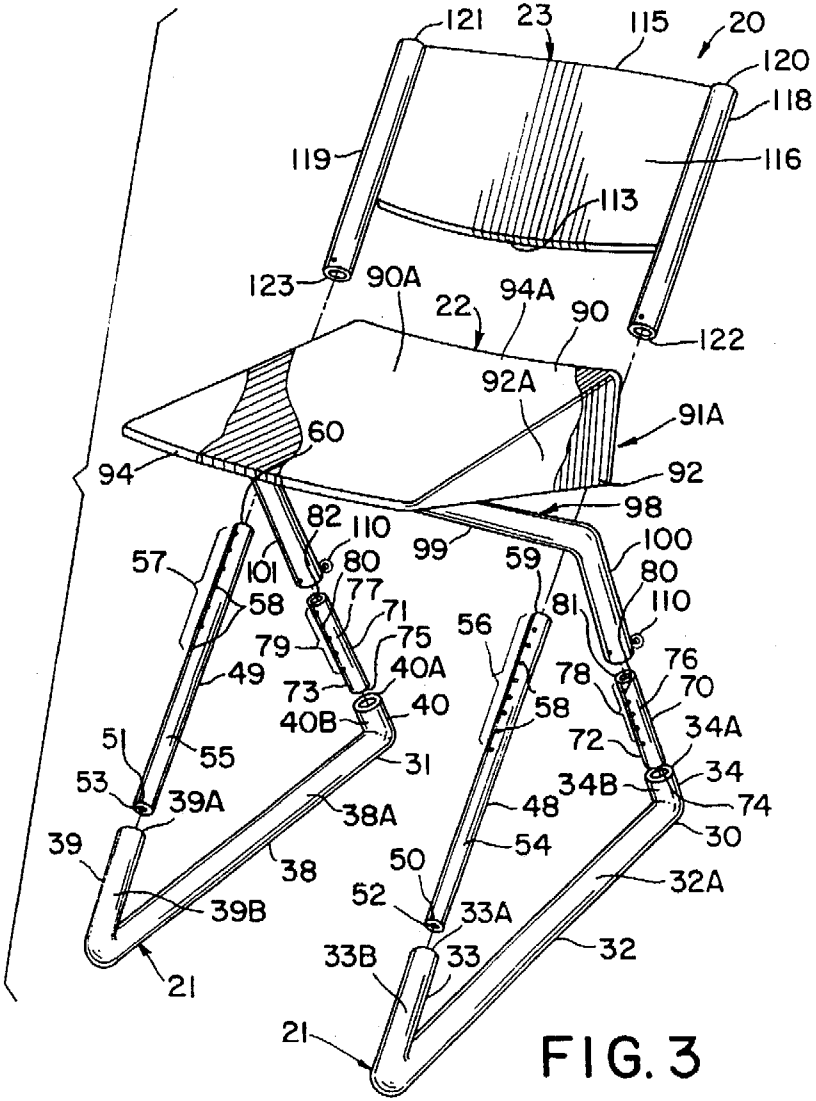
FIG. 3 is an enlarged exploded perspective view of the embodiment illustrated in FIG. 1.

With continuing reference to FIG. 1, and additional reference to FIG. 2 and FIG. 3, the base 21 of the instant invention includes a generally circular first tube member 30 and a generally circular second tube member 31, both of which include portions receivable against an exterior surface such as floor 26 for supporting an elevated assembly. The first tube member 30 includes a generally horizontal intermediate section 32 with front and rear upwardly and inwardly generally convergent terminal sections, 33 and 34 respectively, all of which are integrally formed. Preferably fabricated of a rigid hollow tubular material, first tube member 30 further includes open end 33A associated with section 33, and open end 34A associated with section 34. Sections 32, 33, and 34 further include generally cylindrical outer surfaces, 32A, 33B, and 34B respectively. Sections 33 and 34 function as sockets for receiving other elements or components of the chair 20 as will be described presently.

The second tube member 31 includes a generally horizontal intermediate section 38 with front and rear upwardly and inwardly generally convergent terminal sections, 39 and 40 respectively, all of which are integrally formed. Preferably fabricated of a rigid hollow tubular material, second tube member 31 further includes open end 39A associated with section 39, and open end 40A associated with section 40. Sections 38, 39, and 40 further include generally cylindrical outer surfaces, 38A, 39B, and 40B respectively. Sections 39 and 40 function as sockets for receiving other elements or components of the chair 20 as will be described presently.

Figure 4:
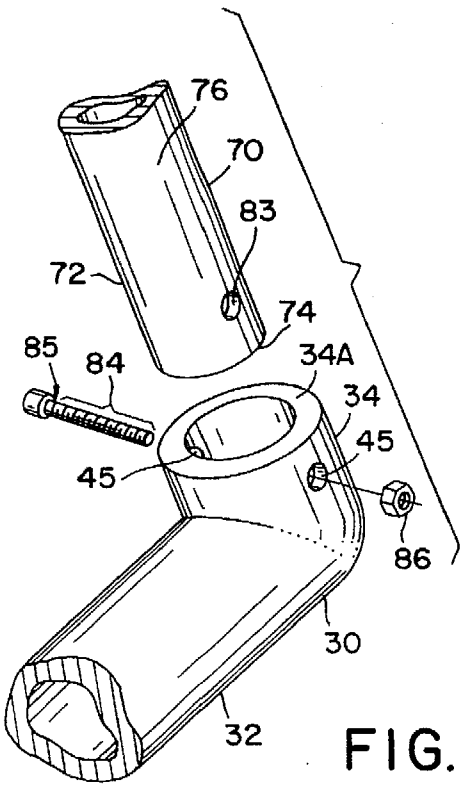
FIG. 4 is an enlarged fragmentary perspective view of an engagement pair of the instant invention.

With momentary reference to FIG. 4, it is seen that section 34 is provided with a diametric bore 45 extending therethrough. A similar bore, although not herein specifically shown, is provided in combination with section 33, 39, and 40, details of which will be described presently.

With continuing reference to FIG. 3, the chair 20 further includes a pair of front upstanding elongate support members 48 and 49. Preferably constructed of a rigid hollow tubular material, the elongate support members 48 and 49 include bottom terminal portions, 50 and 51 respectively, with free ends 52 and 53 respectively, all of which are receivable within the sockets defined by sections 33 and 39. Members 48 and 49 further include generally cylindrical outer surfaces, 54 and 55 respectively, upper terminal portions, 56 and 57 respectively, with a plurality of spaced-apart apertures 58 formed therealong, and free ends, 59 and 60 respectively. It is seen that elongate members 48 and 49 function as front legs for receiving other elements or components of the chair 20 as will be herein presently described.

The chair 20 is also seen as provided with a pair of rear upstanding elongate support members 70 and 71. Preferably constructed of a rigid hollow tubular material, the elongate support members 70 and 71 include bottom terminal portions, 72 and 73 respectively, with free ends 74 and 75 respectively, all of which are receivable within the sockets defined by sections 34 and 40 respectively. Members 70 and 71 further include generally cylindrical outer surfaces, 76 and 77 respectively, upper terminal portions, 78 and 79 respectively, with a plurality of spaced-apart diametric bores 80 formed therealong, and free ends, 81 and 82 respectively.

Elongate members 70 and 71 function as rear legs for receiving other elements or components of the chair 20 as will be described presently.

Again with reference to FIG. 4, it is seen that elongate member 70 is provided with a diametric bore 83 extending therethrough. A similar bore, although not herein specifically shown, is provided in combination with elongate members 48, 49, and 71 proximate free ends 52, 53, and 75 respectively. It will be understood that when the terminal portions 50, 51, 72 and 73 are received within the sockets defined by sections 33, 39, 34, and 40, respectively, diametric bore 83 and diametric bore 45 become aligned. Once the diametric bores, 83 and 45, are aligned, threaded portion 84 of bolt 85 may be received therethrough and threaded nut 86 then threadably received thereon for fixedly and detachably engaging the respective elongate members 48, 49, 70, and 71, to the respective sections 33, 39, 34, and 40, of base 21. The threaded nut 86 and bolt 85 combination herein described is the preferred means of detachably and selectively engaging and securing the elongate members 48, 49, 70, and 71, respectively, to portions of base 21. It will be readily appreciated by those having ordinary skill in the art, that any preferred and suitable engagement means may be used for detachably and selectively engaging elongate members 48, 49, 70, and 71 to the base 21.

Figure 7:
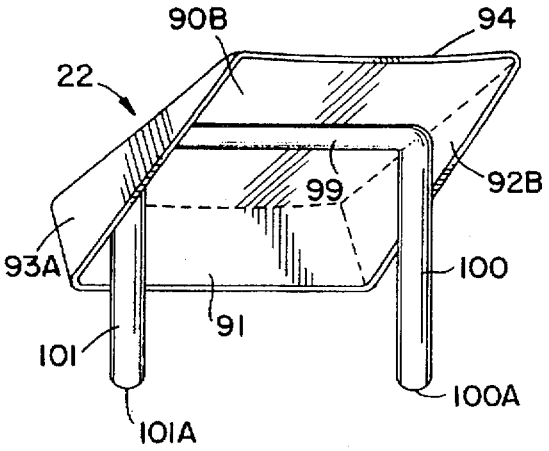
FIG. 7 is an enlarged fragmentary perspective view of a first body supporting element of the instant invention.

With continuing reference to FIG. 3, and additional reference to FIG. 7, the first body supporting element 22 of chair 20, which is preferably constructed of a substantially rigid material such as plastic or wood, is seen as having a main support panel 90, a downwardly extending rear panel 91, forwardly tapered downwardly extending side panels, 92 and 93, all being integrally formed. The main support panel 90 includes a front edge 94, an upper surface 90A and a lower surface 90B. Additionally, the rear panel 91 and the side panels, 92 and 93, each include outer surfaces, 91A, 92A, and 93A, respectively, and inner surfaces, 91B, 92B, and 93B, respectively. Coupled to portions of inner surfaces 90A, 92B, and 93B, is provided a generally U-shaped support member 98. Preferably integrally fabricated of a rigid hollow tubular material, the support member 98 includes an intermediate section 99, and downwardly extending side support sections, 100 and 101, having open free ends 100A and 101A associated therewith respectively. The open free ends, 100A and 101A respectively, are selectively sized to inwardly and telescopingly receive free ends 81 and 82 and the terminal portions 78 and 79 of elongate members 70 and 71 respectively.

Figure 8:
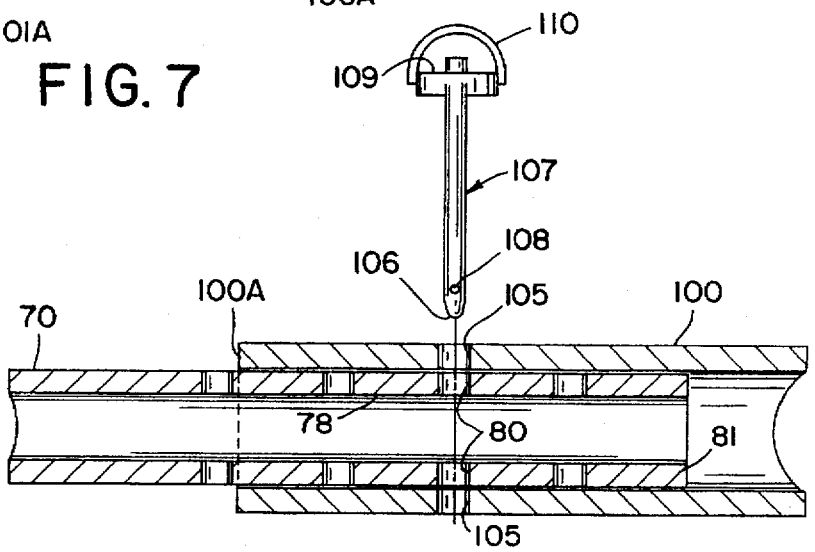
FIG. 8 is an enlarged side sectional view of another engagement means of the instant invention.

With momentary reference to FIG. 8, it is seen that side section 100 is provided with a diametric bore 105. When free end 81 and portions of terminal portion 78 of elongate member 70 are telescoping received therein section 100, one of a selected of the diametric bores 80 may be selectively and desirably aligned with diametric bore 105. Once aligned, the free end 106 of locking pin 107 may be selectively disposed therethrough for selectively and lockingly engaging section 100 to elongate member 70, with the outwardly tensioned protruding member 108 of the locking pin 107 functioning to inhibit the locking pin 107 from disengaging therefrom by snapping outwardly in a locked position once disposed through diametric bores 80 and 105. The locking pin 107 is also seen as having a headed end 109 with a handle portion 110 coupled thereto. The locking pin 107 assembly herein described encompasses the preferred engagement means for selectively and lockingly engaging section 100 to portions of the terminal portion 78 of elongate member 70. It will be readily appreciated by those having ordinary skill in the art, that any preferred and suitable engagement means may be used in lieu of the locking pin 107 assembly herein described. A similar locking pin 107 assembly, although not herein specifically shown, is provided in combination with section 101 and elongate member 71.

Figure 5:
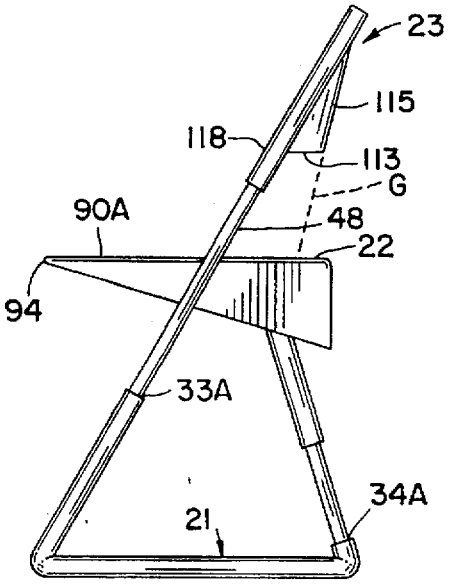
FIG. 5 is a side elevation view of the instant invention very similar to the view of FIG. 2.
Figure 6:
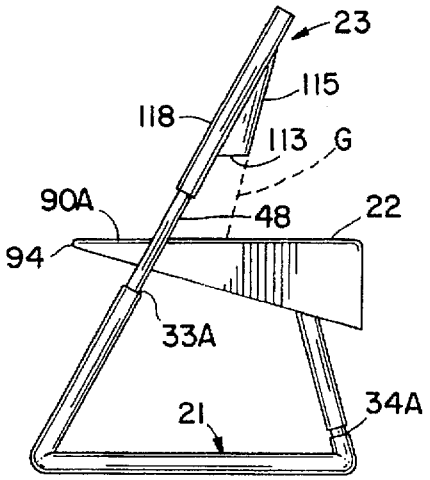
FIG. 6 is a side elevational view of the instant invention very similar to the view of FIG. 5.

Attention is again directed to FIG. 3, and further to FIG. 5 and FIG. 6, which illustrates the second body supporting element 23, which is preferably constructed of a substantially rigid material such as plastic or wood, as having a main support panel 115 having a generally concave inner surface 116, a generally convex outer surface 117, and a bottom edge 113. Support panel 115 further includes integrally attached spaced apart downwardly extending elongate support members, 118 and 119, each having a closed upper end, 120 and 121 respectively, and an open lower end, 122 and 123 respectively, the support members 118 and 119 being preferably constructed of a rigid hollow tubular material. The open free ends, 122 and 123 respectively, are selectively sized to inwardly and telescopingly receive free ends 59 and 60 and the terminal portions 56 and 57, respectively, of elongate members 48 and 49 respectively. A similar locking pin assembly, such as the one herein described in combination with FIG. 8, is similarly provided in combination with section elongate support members 118 and 119, and elongate members 48 and 49, respectively, details of which will not herein again be specifically described.

With specific reference to FIG. 5 and FIG. 6, the first body supporting element 22 is selectively and telescopingly movable between a first position close to open end 34A depicted in FIG. 6, and a second position space-apart from open end 34A of which can be seen in FIG. 5. It will be appreciated that the first body supporting element 22 comprises a seat member, the upper surface 90A of which functions as a seating surface upon which and individual may sit upon. Furthermore, the second body supporting element 22 is selectively and telescopingly movable between a first position close to open end 33A depicted in FIG. 6, and a second position space-apart from open end 33A of which can be seen in FIG. 5. It will be appreciated that the second body supporting element 22 comprises a back support member, the concave inner surface 116 of which functions as a back support surface upon which and individual may position his or her back when seated upon the seating surface defined by upper surface 90A.

As can be seen in FIG. 6, the first body supporting element 22 and the second body supporting element are disposed in angular, telescoping, and diverging relation relative to one another. When the first body supporting element 22 and the second body supporting element 23 are disposed in the first position respectively, the distance between the floor 26 and the seating surface defined by upper surface 90A, and the distance between the bottom edge 113 of the second body supporting element 23 and the floor encompasses a first seating height A, and a first back support height A', respectively. As a result of such a configuration, the accessible seating surface defined by upper surface 90A generally encompasses a first seating area X denoted from and along the angle of the second body supporting element 23 intersecting upper surface 90A designated by dotted line G, and front edge 94 of support panel 90. When the first body supporting element 22 and the second body supporting element 23 are disposed in the second position respectively, the distance between the floor 26 and the seating surface defined by upper surface 90A, and the distance between the bottom edge 113 of the second body supporting element 23 and the floor encompasses a second higher seating height B, and a second higher back support height B', respectively. As a result of such a configuration, the accessible seating surface defined by upper surface 90A generally encompasses larger or expanded second seating area X' denoted from and along the angle of the second body supporting element 23 intersecting upper surface 90A designated by dotted line G, and front edge 94 of support panel 90. As a result of the selectively and alternately adjustable nature of the first body supporting element 22 and the second body supporting element 23, individuals having varied anthropomorphic characteristics may selectively, alternately, telescopingly, and divergingly adjust the first body supporting element 22 and the second body supporting element as desired to meet those specific and unique anthropomorphic needs, selective and alternate adjustment of which facilitating a relative, selective, and desired anthropomorphic effect.

It will be readily appreciated by those having ordinary skill that the first body supporting element 22 and the second body supporting element 23 may be selectively and alternatively adjusted to meet specific anthropomorphic or ergonomic needs of a specific user or individual having a wide range of anthropomorphic characteristics.

Various changes and modifications to the embodiment herein chosen for purposes of illustration will readily occur to those skilled in the mod. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A chair for supporting the human body, and for adjusting to meet the unique ergonomic characteristics of individuals, said chair comprising:

a base member having a front portion and a rear portion;

a pair of spaced upwardly and rearwardly extending parallel back support members, each having first and second ends, with the first ends thereof attached to the front portion of said base member;

a pair of spaced upwardly and forwardly extending parallel seat support members, each having first and second ends, with the first ends thereof attached to the rear portion of said base member;

a seat having a front edge, a rear edge, first and second sides, and a seating surface therebetween upon which a user may sit, said seat adjustably mounted on said seat support members for movement toward and away from the second ends of said seat support members;

a back having first and second sides and a substantially upright back support surface for supporting the back of the user, said back adjustably mounted at the first and second sides thereof on said back support members for movement toward and away from the second ends of said back support members and located in a generally vertically elevated position above said seat and said seat and said back independently adjustable between first positions wherein said seat and said back are positioned proximate a first lowest sealing height and a first lowest back height, respectively, thereby providing a first seating area defined as the area from said front edge of said seat to a first point where a projection of said back onto said seat intersects said seating surface, and second positions wherein said seat and said back are positioned proximate a second higher seating height and a second higher back height, respectively, thereby providing a second seating area defined as the area from said front edge of said seat to a second point where a projection of said back onto said seat intersects said seating surface, said second seating area being greater than said first seating area, since said seat moves forward relative to said base and said back moves rearward relative to said base as said seat and said back are moved from the first positions thereof to the second positions thereof.

2. The chair of claim 1 wherein said parallel back support members each extend upwardly and rearwardly past respective ones of said first and second sides of said seat, causing the second ends of said back support members to terminate in positions above said seat.

3. The chair according to claim 2 wherein said back support members comprise tubular members and said back is adjustably mounted thereto by telescoping tubular members attached at the first and second sides of said back to permit said back to be slidably movable rearwardly upwardly and downwardly forwardly relative to said base.

4. The chair according to claim 3 wherein said pair of seat support members comprise tubular members and said seat has projections extending therefrom for telescoping engagement with the second ends of said seat support members to cause said seat to be movable downwardly rearwardly and upwardly forwardly on said tubular seat support members.

* * * * *